US005495782A

United States Patent [19]

Ruessmann et al.

[11] Patent Number: 5,495,782

[45] Date of Patent: Mar. 5, 1996

[54] POWER WRENCH

[75] Inventors: Klaus Ruessmann, Koenigswinter; Thomas Beyert; Paul-Heinz Wagner, both of Much, all of Germany

[73] Assignee: Paul-Heinz Wagner, Germany

[21] Appl. No.: 231,809

[22] Filed: Apr. 25, 1994

[30] Foreign Application Priority Data

May 6, 1993 [DE] Germany ..... 9306871 U
Apr. 6, 1994 [DE] Germany ..... 9405697 U

[51] Int. Cl.[6] ..... B25B 13/46

[52] U.S. Cl. ..... 81/57.39; 81/57.24; 81/57.4

[58] Field of Search ..... 81/57.39, 57.24, 81/57.4

[56] References Cited

U.S. PATENT DOCUMENTS

| | | | |
|---|---|---|---|
| Re. 33,951 | 6/1992 | Junkers | 81/57.39 |
| 4,794,825 | 1/1989 | Schmoyer | 81/57.4 |
| 4,805,496 | 2/1989 | Wagner et al. . | |
| 5,003,847 | 4/1991 | Wagner | 81/57.39 |
| 5,263,388 | 11/1993 | Beuke | 81/57.39 |
| 5,301,574 | 4/1994 | Knopp et al. | 81/57.39 |

FOREIGN PATENT DOCUMENTS

| | | |
|---|---|---|
| 0276936 | 1/1988 | European Pat. Off. . |
| 4111631 | 4/1991 | Germany . |

*Primary Examiner*—Bruce M. Kisliuk
*Assistant Examiner*—Joni B. Danganan
*Attorney, Agent, or Firm*—Diller, Ramik & Wight

[57] ABSTRACT

The power wrench comprises a housing (10) consisting of a head portion (11) and a drive portion (12). The drive portion (12) contains a cylinder sleeve (21) which is introduced into the housing (10) from the side facing away from the head portion (11). A pressure channel being connected to the hose connector (41) consists of a longitudinal bore (45) extending in the wall of the cylinder sleeve (21) to supply the high pressure required to the rearward cylinder chamber (36). Thereby, it is avoided that the housing (10), in the area of support, is additionally subject to hydraulic pressure. In case of bursting of the pressure duct, the cylinder sleeve (21) is still held together by the housing (10).

11 Claims, 3 Drawing Sheets

122
135
134
136
132
133
144
146
145
142
127
121
120
112
137
140
125
124
141
143
139
138
123
126
128
111
110
131
113
129
130
114
117
118
115
116

153
154
151
136
132
133
135
150
144
145
122
142
127
120
112
141
110
111
123
128
114
118

POWER WRENCH

BACKGROUND OF THE INVENTION

A power wrench disclosed in German Patent Application DE 41 11 631 A1 comprises a housing consisting of a head portion and a drive portion. The drive portion includes an exchangeable cylinder sleeve which is introduced into a corresponding bore of the drive portion from the outside, i.e. from the side facing away from the head portion, and is supported on the inner end of the bore. At the front end of the drive portion, laterally projecting hose connectors for supplying the pressure medium to the cylinder sleeve are arranged. Among these hose connectors, there is a high-pressure connector which is connected to the rearward cylinder chamber via a bore. This bore extends in longitudinal direction through the housing, and it is connected to a transverse bore opening into the cylinder chamber. On the rearward portion of the drive portion of the housing, an external toothing is provided onto which a supporting foot for deviating the reaction forces arising during screwing to a stationary abutment can be set.

SUMMARY OF THE INVENTION

It is the object of the invention to provide a power wrench comprising a cylinder sleeve arranged in the housing, which offers increased security against bursting.

The invention starts from the approach that the drive portion is subject to extremely high strains when a screwing operation with high power is performed. On the one hand, these strains result from the mechanical stress of the drive portion with respect to bending and torsion and, on the other hand, from the hydraulic stress through the high pressure in the range of about 600 to 800 bars which occurs in the pressure duct leading from the hose connector to the rearward cylinder chamber. In prior art, cracks may occur in the drive portion of the housing due to this mechanical and hydraulic double strain. The invention obviates the danger of crack formation or material rupture by giving the drive portion of the housing a solid configuration over its length. The pressure duct extending in the longitudinal direction of the housing does not lead through the housing wall but along the cylinder sleeve either in the form of a tube or as a longitudinal bore through the wall of the cylinder sleeve surrounded by the housing. Thus, the drive portion of the housing only takes over the mechanical stress in order to deviate the reaction forces occurring during screwing to a stationary abutment, whereas the hydraulic stress is exclusively taken over by the cylinder sleeve. The hydraulic stress is a combination of the pressure in the rearward cylinder chamber necessary to advance the piston, and the supply pressure prevailing in the pressure duct. The cylinder sleeve has such a strength that it withstands the hydraulic pressures without substantial deformation. It thus forms an independent cylinder which is only held in position by the housing. The pressure duct extends through the wall of this cylinder sleeve either as a bore or as an external tube along the cylinder sleeve. Should the material of the cylinder sleeve break due to the high pressure, the parts of the cylinder sleeve are still held together by the surrounding housing so that no fractions can fly about and lead to damage and injuries. On the other hand, the housing can be configured so as to have thinner walls than in the case that the pressure duct extends through the housing wall in the longitudinal direction of the housing. In particular, it is avoided that the pressure duct extends radially into the vicinity of the external toothing of the housing to which the support foot is mounted, and causes a material weakening there.

Another advantage is that the manufacture of the power wrench is simplified because it is easier to mount the pressure duct to the cylinder sleeve than to the housing which is a complex component.

BRIEF DESCRIPTION OF THE DRAWINGS

Embodiments of the invention will be described more detailed hereunder with reference to the drawings, in which.

DESCRIPTION OF THE PREFERRED EMBODIMENTS

Figure 1:
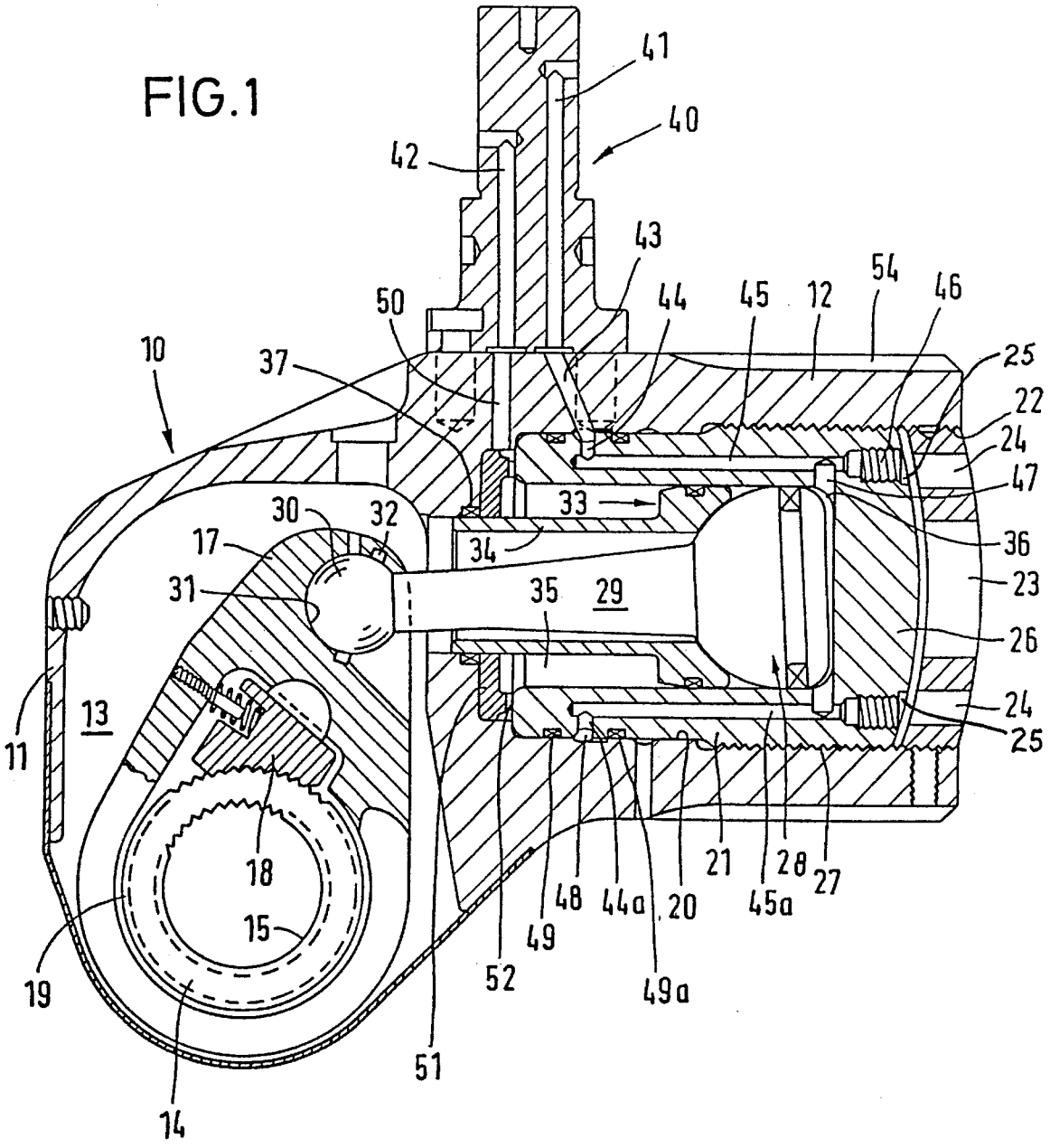
FIG. 1 is a schematic longitudinal section of a first embodiment of the power wrench.

Referring to FIG. 1, the power wrench comprises a one-piece housing 10 consisting of a head portion 11 and a drive portion 12. The head portion 11 comprises a working chamber 13 being defined by two parallel plate-shaped walls. The annular member 14 is rotatably supported in these walls. The annular member 14 comprises an opening with an internal toothing 15 in which the shank of a button die can be inserted which is set onto the bolt head to be turned.

The annular member 14 supports a lever 17 comprising a spring-loaded ratchet element 18 which can engage with an outer ratchet toothing 19 of the annular member. The ratchet element 18 is arranged and supported by the lever 17 in such a manner that the lever 17 always pushes the annular member in one rotational direction only, but returns in the other rotational direction without pushing the annular member.

In the drive portion 12, the cylinder sleeve 21 is arranged in a bore 20. The housing opening 22, from which the cylinder sleeve 21 is inserted into the housing, is located at the outer end of the drive portion 12 which faces away from the head portion 11. This opening 22 is provided with a thread into which a lid 23 is screwed. At its outside, the lid 23 is provided with bores 24 into which a tool for turning the lid can be inserted. Similar bores 25 are located at the outside of the bottom 26 of the cylinder sleeve 21. This bottom 26 is supported on the lid 23.

Furthermore, the rearward end of the cylinder sleeve 21, which faces away from the head portion 11, is provided with an external thread 27 extending over about half the length of the cylinder sleeve and can be screwed into an inner thread of the bore 20.

The cylinder sleeve 21 forms the hydraulic cylinder in which the piston 28 is displaceable. Here, the piston 28 is configured as a spherical piston which can assume different pivotal positions within the cylinder sleeve 21 while maintaining the seal with respect to the cylinder wall. The piston rod 29 is rigidly mounted to piston 28. At the end of the piston rod 29, there is a spherical head 30 seated in a spherical bearing 31 of the lever 17. At this bearing 31, a catch device 32 in the form of a clamping spring arrangement is provided which encompasses the head 30, thus retaining it in the bearing 31. When the head 30 is pressed against the lever 17, the catch device 32 opens to close again behind the head 30 and thus retain the head in the bearing 31.

Apart from the piston 28, an auxiliary piston 33 for the return stroke is provided in the cylinder sleeve 21. This auxiliary piston 33 has a cylindrical piston face so that it cannot be tilted. A bushing 34 projects from the auxiliary piston 33 toward the working chamber 13. In the wall between the head portion 11 and the drive portion 12, a seal 37 is provided which encompasses the bushing 34 and seals the front cylinder chamber 35. The front cylinder chamber 35 is limited by the auxiliary piston 33, and the rearward cylinder chamber 36 by the piston 28 and the bottom 26.

On the front portion of the drive portion 12 adjacent to the head piece 11, a connection device 40 is attached to which pressure hoses can be connected. This connection device 40 comprises a first hose connector 41 and a second hose connector 42. The first hose connector 41 serves as a high-pressure connector to which the full working pressure of 600 to 800 bars is supplied, and the second hose connector 42 is a low-pressure connector to which a considerably lower pressure for resetting the pistons 28 and 33 is supplied. The hose connector 41 is connected to a transverse bore 43 extending through a wall of the housing 10, which communicates with bore 20. In the cylinder sleeve 21, a radial pocket bore 44 is provided at the end of the transverse bore 43, to which a longitudinal bore 45 is connected that extends into the interior of the wall of the cylinder sleeve. At its rear end, the longitudinal bore 45 is closed by a plug 46. At its rear end, the cylinder bore of the cylinder sleeve 21 comprises an enlargement 47 in the form of an undercut. This enlargement 47 extends into the longitudinal bore 45 and connects it to the rearward cylinder chamber 36.

In the present embodiment, the pocket bore 44 is located on the bottom of a circumferential groove 48 of the cylinder sleeve. From this circumferential groove 48, another pocket bore **44*a* and another longitudinal bore 45*a* extend toward the enlargement 47. Since the volume of the pressure duct is distributed onto to more than one longitudinal bore 45,45*a***, these longitudinal bores can have a relatively small cross section, resulting in that the wall forces generated by the pressure remain low.

On both sides of the annular groove 48, seals 49 and **49*a*** are provided.

The hose connector 42 is connected to a transverse bore 50 which communicates with bore 20 in front of the front end of the cylinder sleeve. There, a lid 51 is arranged which supports the front end of the cylinder sleeve 21 and comprises radial passages 52. The lid 51 also serves for centering the bushing 34.

At its rear half, the drive portion 12 is provided with a spline toothing 54 on the outside thereof, onto which a ring of a support foot (not shown), which is provided with a counter toothing, can be set. This support foot may be set against a stationary abutment to deviate the reaction forces occurring during screwing. Therefore, high bending and torsion moments may occur on the drive portion in the area of the spline toothing 54. The drive portion should be configured to withstand this strain. In the area of the spline toothing 54, however, no hydraulic pressure acts upon the drive portion of the housing. This hydraulic pressure acts only on the cylinder sleeve 21.

If a material rupture occurs in the cylinder sleeve 21, the cylinder sleeve is still held together by the housing 10. Therefore, there is no danger that parts of the power wrench fly about due to the bursting of a hydraulic channel.

During the operation of the power wrench, a working stroke is performed by pressurizing duct 41 while duct 42 is depressurized. The piston 28 is advanced by the pressure in the cylinder chamber 36 whereby the piston rod 29 presses against the lever 17 and rotates the annular member 14 via the ratchet element 18. The piston 28 pushes the auxiliary piston 33. During the return stroke, duct 42 is pressurized, while duct 41 is depressurized. The auxiliary piston 33 is driven by the pressure in the cylinder chamber, driving the piston 28 in the rearward end position.

Figure 2:
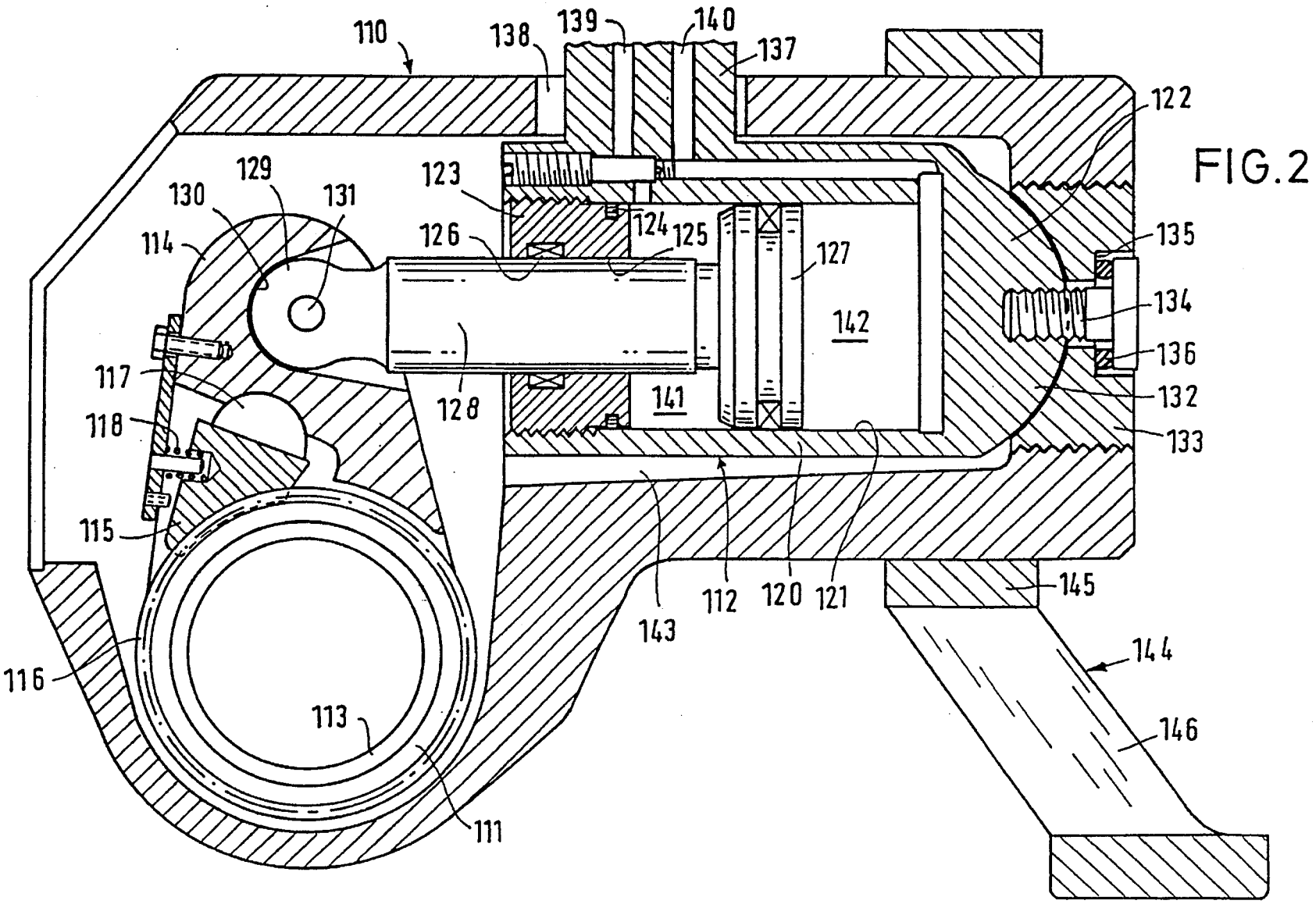
FIG. 2 is a schematic longitudinal section of a second embodiment of the power wrench.

The power wrench according to FIG. 2 comprises a substantially L-shaped housing 110 containing a rotatably supported annular member 111 in one leg and the working cylinder 112 in the other leg. The annular member 111 comprises an inner toothing 113 into which the external toothing of a button die (not shown) can be inserted so that the annular member 111 is rotatably connected to the button die. The ratchet lever 114 is supported coaxially to the annular member 111 and comprises a movable ratchet member 115 which engages in an external toothing 116 of the annular member 111. By means of a ball 117, the ratchet shoe 115 is supported in a ball socket of the ratchet lever 114, and it is pressed towards the annular member 111 by a spring 118.

The working cylinder 112 consists of a one-piece cylinder body 120 in which the cylinder bore 121 is configured as a pocket bore. This pocket bore is limited by the bottom wall 122 integrally formed to the cylinder body. The front end of the cylinder body 120 is closed by a plug 123 which is screwed into a thread of the cylinder body. The plug 123 is sealed against the cylinder bore 121 by means of a seal 124. It comprises a passage 125 for the piston rod. This passage 125 comprises a seal 126.

The piston 127 is axially movable in the cylinder bore 121. This piston comprises a piston rod 128 rigidly mounted thereto which projects through the passage 125 of the plug 123. The front end of the piston rod 128 is configured as spherical head 129 seated in a ball socket 130 of the ratchet lever 114. A pin 131, retaining the head 129 at the ratchet lever 114 and effecting that the ratchet lever 114 follows the return movement of the piston 127, passes through the head 129. During the working stroke, the pin 131 does not effect any substantial force transmission.

A convex spherical dome 132 seated in a spherical bearing cup of a bearing 133 is formed to the bottom wall 122. The bearing 133 is screwed into the rearward end wall of the housing 110. A bolt 134 passes through a bore of the bearing 133, is screwed into a thread of the dome 132 and engages, with its head, a ring shoulder 135 of the bearing 133. Between the bolt head and the ring shoulder 135, an elastic ring 136 is located permitting pivotal movements of the bolt 134 relative to the bearing 133.

A connection piece 137 laterally projects from the front portion of the cylinder body 120. This connection piece 137 projects, with clearance, through an opening 138 of the housing 110. Bores 139,140 extend through the connection piece 137. The bore 139 communicates with the front cylinder chamber 141 and the bore 140 communicates with the rearward cylinder chamber 142. On the connection piece 137, hose connectors (not shown) for connecting external hoses to the bores 139 and 140 are provided.

The cylinder body 112 is contained in the housing 110 in a chamber 143 being so large that it permits pivotal movements of the cylinder body about the central point of the dome 132. Such pivotal movements occur during the reciprocating movement of the piston 127 due to the fact that the ratchet lever 114 is pivoted about the axis of the annular member 111 and the piston rod 128 must follow the pivotal movements of the ratchet lever 114. The piston-cylinder unit consisting of the cylinder 112 and the piston 127 with the piston rod 128 is rigid in lateral direction and follows, as a whole, the pivotal movements of the ratchet lever 114. Due to the fact that both ends of the piston-cylinder unit are spherically supported and the piston-cylinder unit is rigid per se, no lateral guidance of the cylinder is required.

During a working stroke, the cylinder chamber 142 is pressurized, while the cylinder chamber 141 is depressurized. Then, the piston 127 is advanced and it presses the ratchet lever 114 forwardly. Thereby, the screwing head is rotated via the annular member 111. Subsequently, the return stroke is performed, wherein the cylinder chamber 141 is pressurized, while the cylinder chamber 142 is depressurized. The piston 127 then moves to its rearward end position. By the bolt 134, the cylinder 112 is retained at the housing 110 and the ratchet lever 114 is pivoted back, the ratchet member 115 sliding over the toothing 116 of the annular member 111.

In order to support the housing 110 on a stationary abutment, a support foot 144 is provided on the housing. This support foot comprises a ring 145 surrounding the rearward housing section. Outside, this housing section comprises a polygonal profile (e.g., hexagon profile) on which the inner profile of the ring 145 fits. This means that the ring 145 can be set onto the rearward housing section in different rotational positions. An arm 146 laterally projects from the ring 145.

Due to the fact that the connection piece 137 is arranged on the front portion of the working cylinder 112, the connection piece 137 does not hinder the support foot 144.

Figure 3:
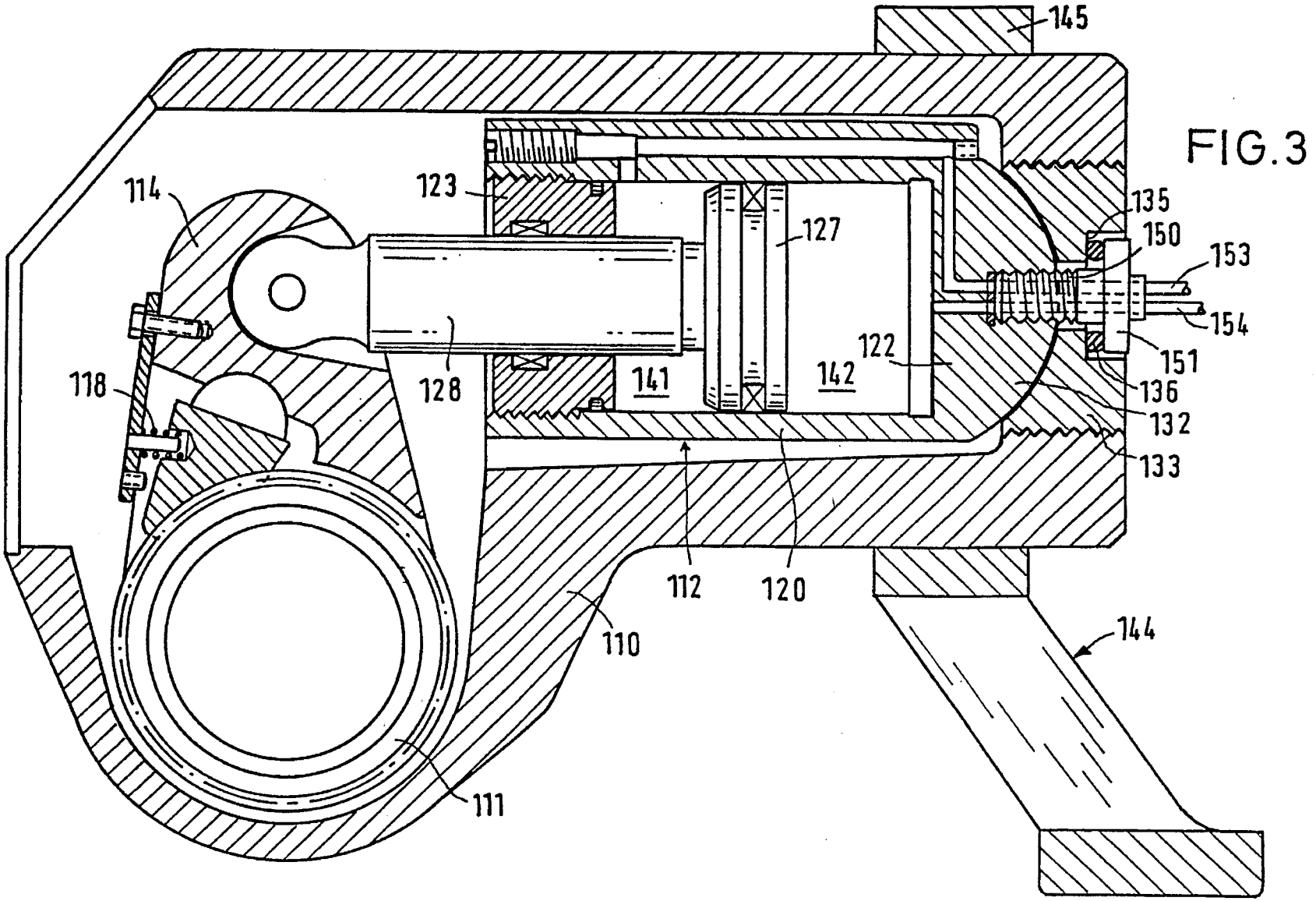
FIG. 3 is a schematic longitudinal section of a third embodiment of the power wrench.

Generally, the embodiment of FIG. 3 is configured in the same way as that of FIG. 2, the following description being confined to the differences.

According to FIG. 3, a hose connector 150 is provided at the rearward end of the housing 110. This hose connector 150 is screwed into the spherical dome 132 of the bottom wall of the cylinder body 120. The hose connector 150 replaces the bolt 134 of FIG. 2 and comprises a flange 151 which is supported on the ring shoulder 135 by means of a flexible ring 136. The hose connector 150 connects the two hoses 153,154 to the cylinder chambers 141 and 142. At the same time, it acts as an anchoring element for retaining the working cylinder 112 during the return stroke. The hose connector 150 which has a corresponding movability in the bearing 133 participates in the pivotal movements of the working cylinder 112. The support foot 144 is movable in the longitudinal direction of the housing 110.

We claim:

1. A power wrench comprising a housing (10) having a front end and a rear end, said housing (10) including a head portion (11) at said front end housing a rotatably supported annular member (14) and a rotatably supported lever (17) for driving said annular member (14), said housing rear end including a drive portion (12) having a front portion more adjacent said housing front end than a rear portion of said drive portion (12), a cylinder sleeve (21) within said drive portion (12), a piston (28) movable in said cylinder sleeve (21), a piston rod (29) connected to said piston (28) and engaging said lever (17), said piston (28) and a rear portion of said cylinder sleeve (21) at said rear portion of said drive portion (12) defining a cylinder chamber (36) of said cylinder sleeve (21), a hose connection device (40) having a pair of hose connectors (41, 42), said hose connection device (40) being located at said front portion of said drive portion (12), a pressure channel (45) extending in said cylinder sleeve (21) substantially longitudinally relative to an axis of said cylinder sleeve (21), a transverse bore (43) extending through said front portion of said drive portion (12) and being in fluid communication with one (41) of said pair of hose connectors (41, 42) and said pressure channel (45), the fluid communication between said transverse bore (43) and said pressure channel (45) including a circumferential groove (48) in an exterior surface of said cylinder sleeve (21) in fluid communication with said pressure channel (45) via a transverse bore (44) in said cylinder sleeve (21), and another bore (47) placing said pressure channel (45) in fluid communication with said cylinder chamber (36) of said cylinder sleeve (21) at said housing rear end.

2. The power wrench as defined in claim 1 wherein said pressure channel (45 or 45*a*) is defined by at least two longitudinal bores (45, 45*a*) which are connected at a front portion of the cylinder sleeve (21) to an outer circumferential annular groove (48).

3. The power wrench as defined in claim 1 wherein another (42) of said hose connectors (41, 42) is connected to a transverse bore (50) of the housing (10) in fluid communication with a front portion of said cylinder sleeve (21).

4. The power wrench as defined in claim 3 including an annular ring (51) in an area in which the transverse bore (50) opens into the housing, said annular ring (51) axially supports the cylinder sleeve (21), a radial passage (52) in said annular ring (51) placing said transverse bore (50) in fluid communication with said cylinder sleeve front portion, and said annular ring (51) centers a bushing (34) movable with the piston (28).

5. The power wrench as defined in claim 1 wherein a section of the housing (110) comprising the cylinder sleeve (120) has one of a polygonal profile and a spline-shaft profile for holding an annular holder (145) of a support foot (144).

6. The power wrench as defined in claim 1 wherein a front end of the piston rod (29) is spherically supported at the lever (17).

7. A power wrench comprising a housing (10) having a front end and a rear end, said housing (10) including a head portion (11) at said front end housing a rotatably supported annular member (14) and a rotatably supported lever (17) for driving said annular member (14), a cylinder sleeve (21) within a drive portion (12) of said housing (10), a piston (28) movable in said cylinder sleeve (21), a piston rod (29) connected to said piston (28) and engaging said lever (17), said piston (28) and a rear portion of said cylinder sleeve (21) defining a cylinder chamber (36) of said cylinder sleeve (21), a hose connection device (40) having a pair of hose connectors (41, 42), a pressure channel (45) extending in said cylinder sleeve (21) substantially longitudinally relative to an axis of said cylinder sleeve (21), a transverse bore (43) extending through said drive portion (12), a circumferential groove (48) in an exterior surface of said cylinder sleeve (21), said transverse bore (43) being in fluid communication with one (41) of said pair of hose connectors (41, 42) and said circumferential groove (48), a transverse bore (44) placing said circumferential groove (48) in fluid communication with said pressure channel 45, and said cylinder sleeve rear portion having an external thread (27) in threaded engagement with a thread at said housing rear end.

8. A power wrench comprising a housing (10, 110) having a front end and a rear end, said housing (10, 110) including a head portion (11) at said front end housing a rotatably supported annular member (14) and a rotatably supported lever (17) for driving said annular member (14), a cylinder sleeve (21, 120) within a drive portion (12) of said housing (10, 110), a piston (28, 127) movable in said cylinder sleeve (21), a piston rod (29, 128) connected to said piston (28, 127) and engaging said lever (17), said piston (28, 127) and a rear portion of said cylinder sleeve (21, 120) defining a cylinder chamber (36) of said cylinder sleeve (21, 120), a hose connection device (40) having a pair of hose connectors (41, 42), a pressure channel (45) extending in said cylinder sleeve (21, 120) substantially longitudinally relative to an axis of said cylinder sleeve (21, 120) and being in fluid communication with said cylinder chamber (36), said cylinder sleeve (120) being pivotally supported within said housing (110), and said cylinder sleeve (120) including a pocket bore (121) closed by a plug (123) including a sealed passage (125) slidably receiving the piston rod (128) of the piston (127).

9. The power wrench as defined in claim 8 wherein said cylinder sleeve (120) includes at a front portion adjacent to said plug (123) a laterally projecting connection piece (137) passing through an opening (138) of said housing (110).

10. The power wrench as defined in claim 8 wherein said cylinder sleeve (120) includes a bottom wall (122) facing away from said plug (123), and at least one hose connector (150) passing through a bearing (133) of said housing (110) supporting a bottom wall (122) of said cylinder sleeve (120).

11. The power wrench as defined in claim 8 wherein said cylinder sleeve (120) includes a bottom wall (122) spherically supported by said housing (110).

* * * * *